US007325501B2

(12) United States Patent
Yamasaki

(10) Patent No.: US 7,325,501 B2
(45) Date of Patent: Feb. 5, 2008

(54) PRESSER FOOT LIFTING LEVER FOR SEWING MACHINE AND SEWING MACHINE

(75) Inventor: Hiroshi Yamasaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/700,870

(22) Filed: Feb. 1, 2007

(65) Prior Publication Data

US 2007/0204777 A1 Sep. 6, 2007

(30) Foreign Application Priority Data

Mar. 2, 2006 (JP) ..... 2006-055750

(51) Int. Cl.
*D05B 29/02* (2006.01)
*D05B 27/00* (2006.01)

(52) U.S. Cl. ..... 112/237

(58) Field of Classification Search ..... 112/235–239
See application file for complete search history.

(56) References Cited

U.S. PATENT DOCUMENTS 21,671 A * 10/1858 Grover ..... 112/237
1,096,407 A * 5/1914 Vannette ..... 112/239
1,134,477 A * 4/1915 Merritt ..... 112/237
2,139,426 A * 12/1938 Toskey et al. ..... 112/236
2,422,820 A * 6/1947 Best ..... 112/237

FOREIGN PATENT DOCUMENTS

JP A 8-57174 3/1996
JP A 2002-66181 3/2002

* cited by examiner

*Primary Examiner*—Ismael Izaguirre
(74) *Attorney, Agent, or Firm*—Oliff & Berridge PLC

(57) ABSTRACT

A presser foot lifting lever for a sewing machine includes a lever body rotatably supported about a horizontal shaft center by a head; a handle operated by the user; and a connecting portion connecting the handle to the lever body. The connecting portion allows the handle to be switched relative to the lever body between a predetermined active position taken to allow user operation and a predetermined retracted position taken when not in use.

9 Claims, 11 Drawing Sheets

PRESSER FOOT LIFTING LEVER FOR SEWING MACHINE AND SEWING MACHINE

CROSS-REFERENCE TO RELATED APPLICATIONS

This application is based upon and claims the benefit of priority from the prior Japanese Patent Application No. 2006-055750, filed on, Mar. 2, 2006 the entire contents of which are incorporated herein by reference.

FIELD

The present disclosure is directed to a presser foot lifting lever operated to vertically move a presser foot of a sewing machine and a sewing machine provided with the presser foot lifting lever.

BACKGROUND

A household sewing machine is generally provided with a bed, a foot, and an arm. A presser bar having a presser foot mounted at the lower end thereof is supported vertically movably by a head situated at the distal end of the arm. The head also has a presser foot lifting lever mounted thereto which vertical operation vertically moves the presser foot along with the presser bar.

A conventional presser foot lifting lever has a handle integrally provided at the distal end thereof to allow user operation. For instance, the sewing machine disclosed in JP 2002-66181 A (patent document 1) has a presser foot lifting lever mounted to the head so as to project into the recess defined by the bed, the foot and the arm. The sewing machine disclosed in JP H08-57174 A (patent document 2) has a presser foot lifting lever mounted to the head such that the presser foot lifting lever projects rearward relative to the laterally-oriented arm in front view.

The sewing machine described in patent document 1 has the presser foot lifting lever mounted to the head so as to project into the aforementioned recess. Thus, such arrangement provides high operability of the presser foot lifting lever when the user faces the sewing machine with the arm extending in the lateral direction. However, such disposition of the presser foot lifting lever has negative aspects during the sewing operation such as: the handle of the presser foot lifting lever interfering with the user's hands upon rearrangement of the workpiece, and the workpiece being caught by the handle of the presser foot lifting lever when sewing a large workpiece that projects into the recess. As described above, such presser foot lifting lever becomes an impediment to the sewing process.

Conversely, the presser foot lifting lever of the sewing machine described in patent document 2 is attached to the head so as to project rearward relative to the laterally oriented arm. Thus, the problem experienced in the sewing machine described in patent document 1 is resolved. However, such arrangement in turn gives rise to poor operability since the user is required to operate the presser foot lifting lever by extending his/her arm around to the rear side of the head.

To summarize, the presser foot lifting lever projecting into the recess and the presser foot lifting lever projecting rearward have contradicting advantages and disadvantages, thus it has been a challenge to the industry to overcome the disadvantages at once.

SUMMARY

An object of the present disclosure is to provide a presser foot lifting lever for a sewing machine with improved operability and usability by preventing the handle from interfering with the user's hands or the workpiece especially during the sewing operation. It is also another object of the present disclosure to provide a sewing machine provided with such presser foot lifting lever.

The presser foot lifting lever for a sewing machine of the present disclosure is used for vertical operation of a presser foot which presser foot provided in a lower end of a presser bar supported by a head provided in a distal end of a sewing machine arm. The presser foot lifting lever includes a lever body rotatably supported by the head about a horizontal shaft center; a handle operated by a user; a connecting portion connecting the handle to the lever body; and the connecting portion allows the handle to be switched relative to the lever body between a predetermined active position taken to allow user operation and a predetermined retracted position taken when not in use.

According to the above configuration, the user is allowed to improve the operability of the presser foot lifting lever by switching the presser foot lifting lever to an active position and arranging the handle to project into the recess to an extent that does not interfere with sewing activities. By switching the handle to the retracted position when the presser foot lifting lever is not in use, enhanced usability can be achieved upon sewing, carrying and storing the sewing machine since the presser foot lifting lever provides no interference. Also, even in rearranging the workpiece or sewing a sizable workpiece that projects into the recess, the presser foot lifting lever can be prevented from interfering with the user's hands and the workpiece.

In such case, it is preferable to render the connecting portion to establish a connection between the handle and the lever body so that the handle is foldable relative to the lever body and allow switching between the active position and the retracted position by the rotation of the handle. Also, the connecting portion may establish a connection between the handle and the lever body so that the handle is extendible relative to the lever body and allow switching between the active position and the retracted position by the extension of the handle.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

A first embodiment of the present invention will be described with reference to FIGS. 1 to 8.

Figure 1:
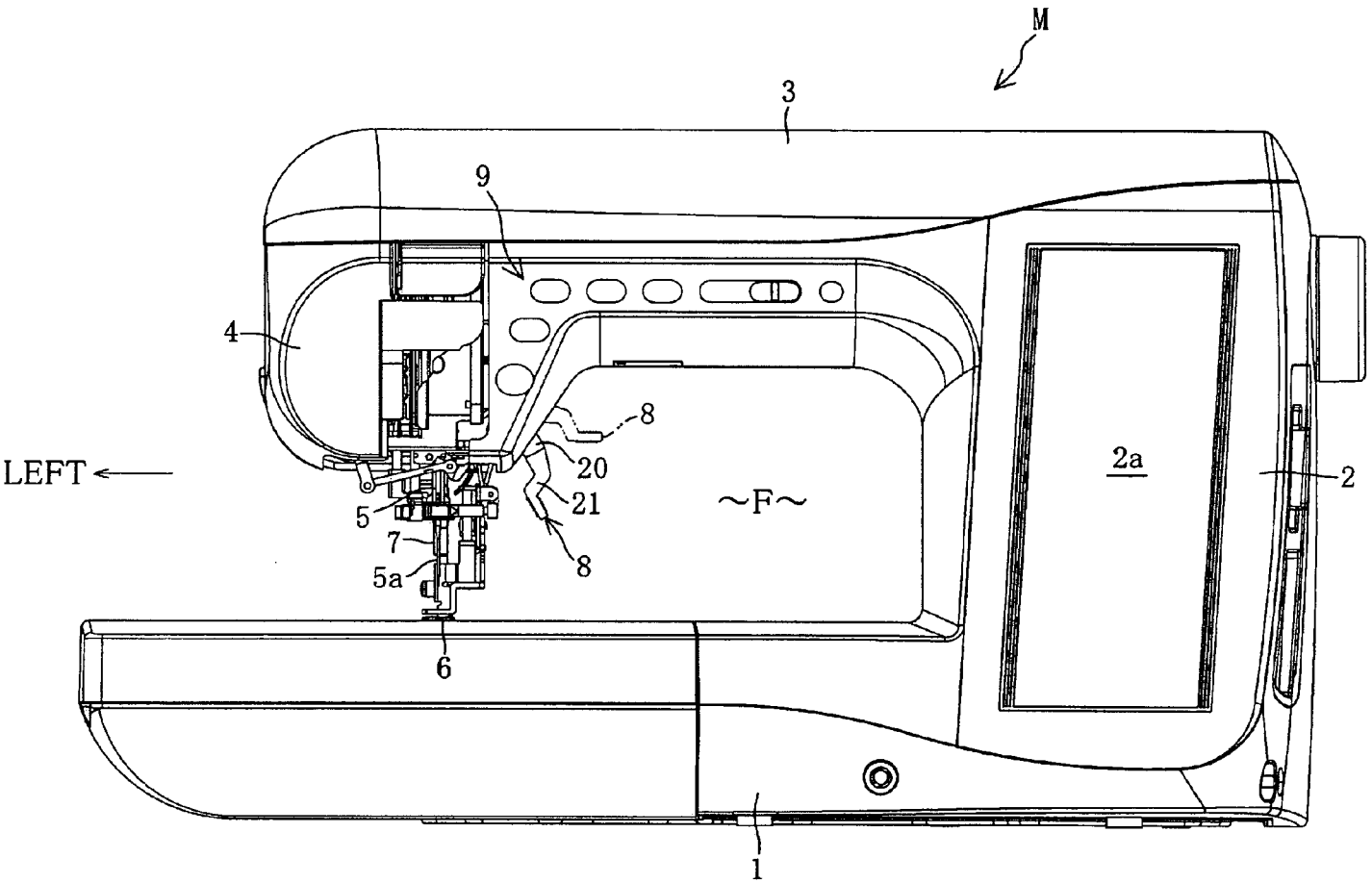
FIG. 1 is a front view of a sewing machine in accordance with a first illustrative aspect of the present disclosure.

Referring to FIG. 1, a sewing machine M is provided with a bed 1, a foot 2, and an arm 3 and the foot 2 stands at the right portion of the bed 1. The arm 3 extends leftward from the upper portion of the foot 2. A head 4 is provided at the left end of the arm 3.

The head 4 includes a needle bar 5 having a sewing needle 5*a* mounted at the lower end thereof; a thread take-up (not shown); a presser bar 7 having a presser foot 6 mounted at the lower end thereof; and a presser foot lifting lever 8 used for vertically moving the presser foot 6. A liquid crystal display 2*a* is provided on the front face of the foot 2. Various operation switches 9 are provided on the front faces of the arm 3 and the head 4.

Figure 2:
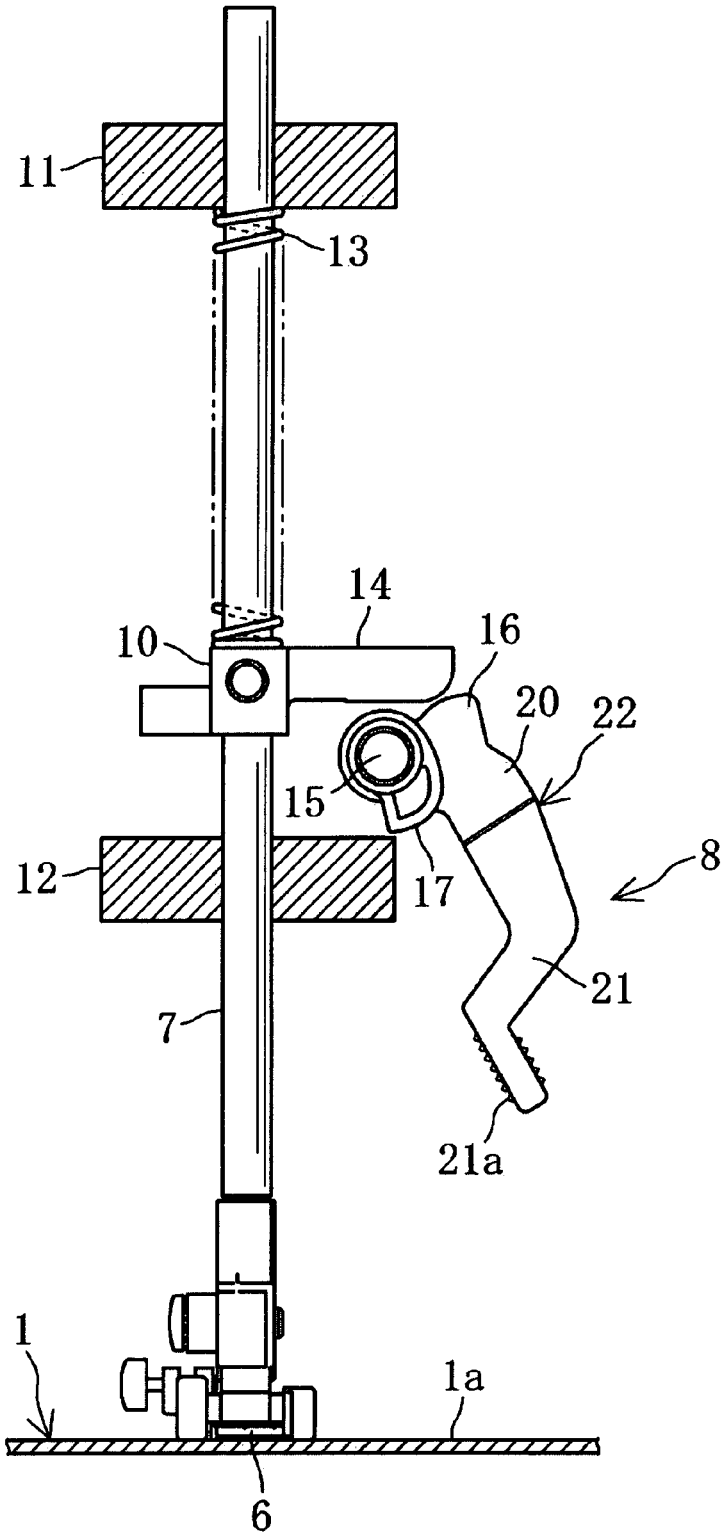
FIG. 2 is a front view of a presser foot lifting lever in a presser foot lowered position and a presser bar.
Figure 3:
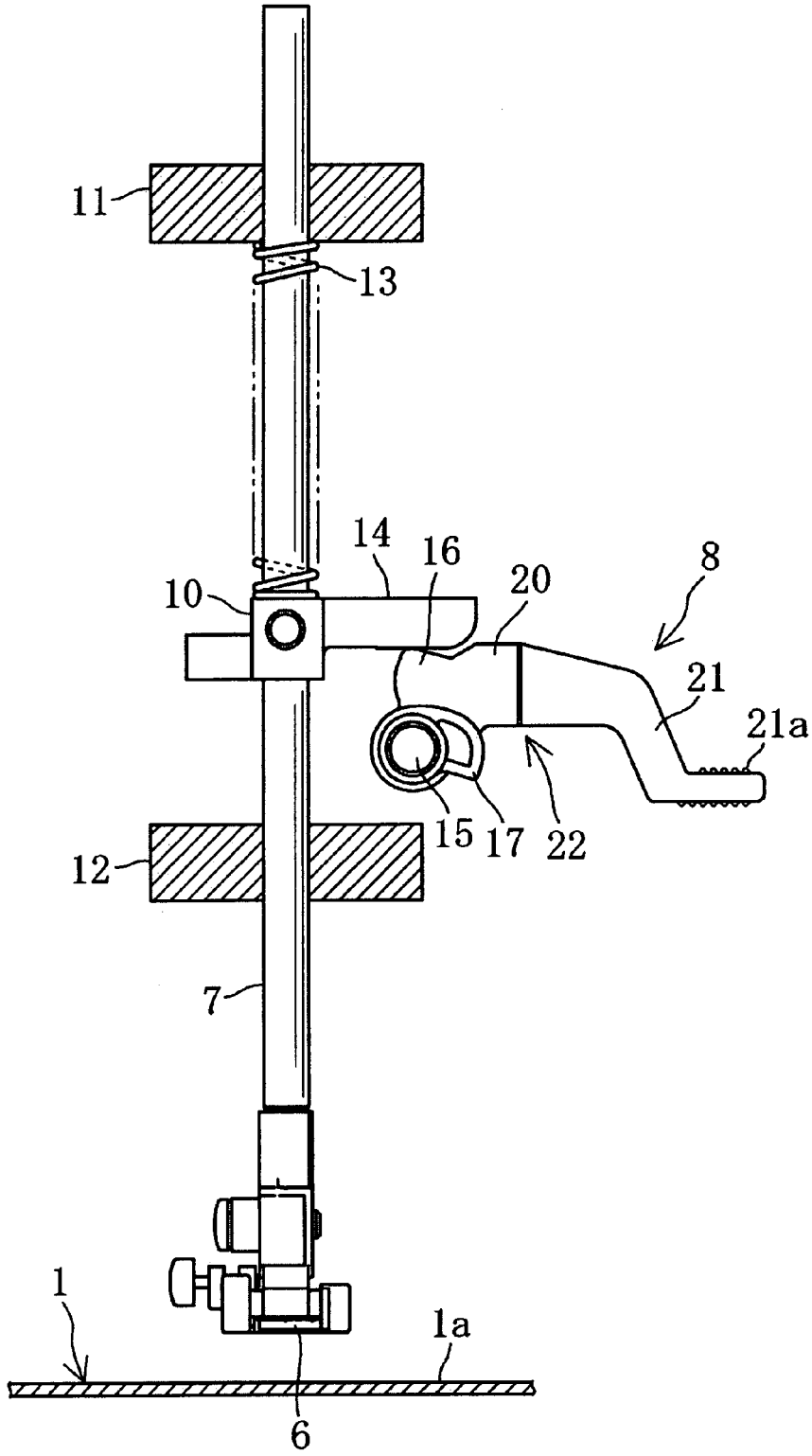
FIG. 3 is a front view of a presser foot lifting lever in a presser foot lifted position and a presser bar.
Figure 4:
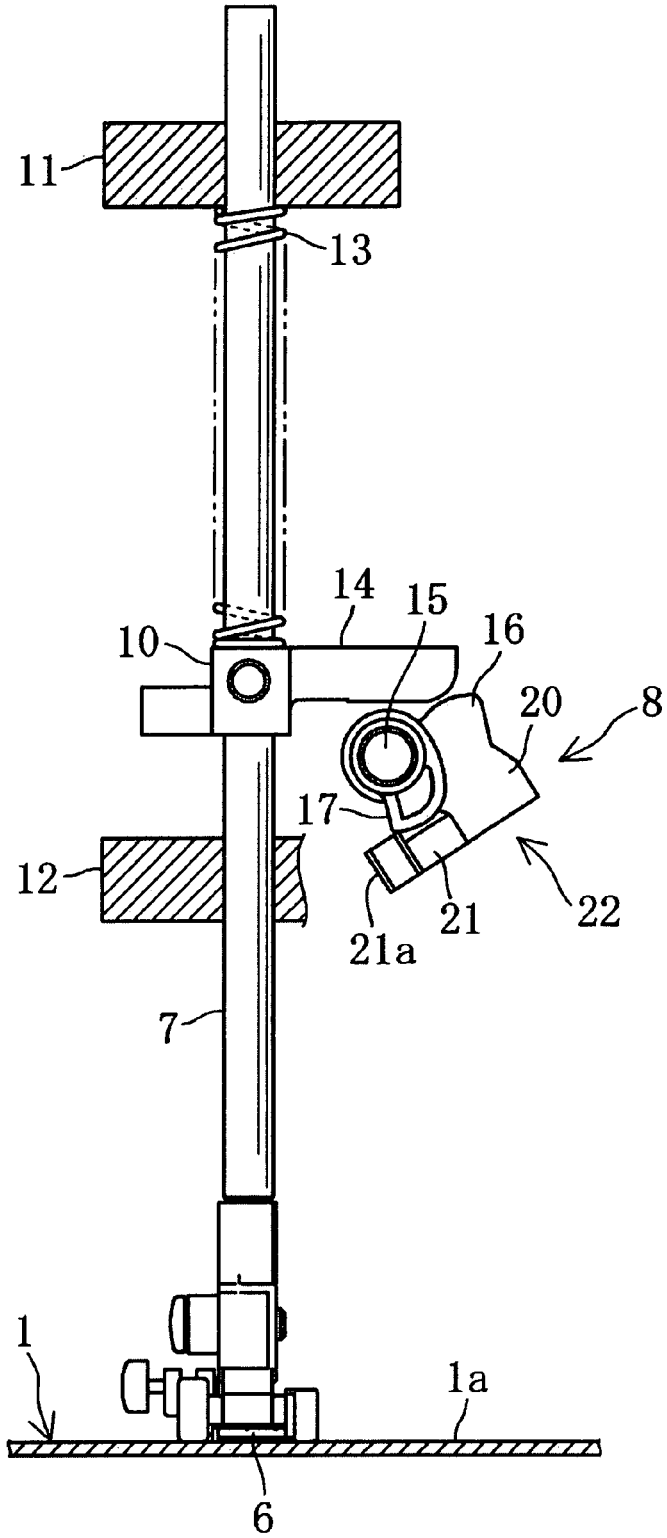
FIG. 4 is a front view of presser foot lifting lever and the presser bar in which the presser foot lifting lever is in the presser foot lowered position and a handle is in a retracted position.

Referring to FIGS. 2 to 4, the vertically-oriented presser bar 7 is provided in the rear side of the needle bar 5. The presser bar lifting lever 8 is disposed in the right side of the presser bar 7. A presser bar clamp 10 is secured by fitting engagement with the presser bar 7 at a substantial vertical mid-portion of the presser bar 7.

The presser bar 7 is provided in the machine frame of the head 4. More specifically, the presser bar 7 is inserted through a pair of guide members 11 and 12 positioned in the upper and lower sides of the presser bar clamp 10 which guide members 11 and 12 guide the presser bar 7 vertically movably. A compression coil spring 13 is wound on the presser bar 7 at a portion between the presser bar clamp 10 and the upper guide member 11. The presser bar 7 is downwardly biased by the compression coil spring 13. A rightwardly extending cam engagement portion 14 is secured to the presser bar clamp 10. A longitudinally oriented shaft member 15 is disposed below the cam engagement portion 14. The base end of the presser foot lifting lever 8 is supported rotatably by the machine frame of the head 4 via the shaft member 15. When the presser foot lifting lever 8 is in a operable position (active position of later described handle 21), the presser foot lifting lever 8 projects in suitable extent into a recess F defined by the bed 1, the foot 2 and the arm 3.

The base end of the presser foot lifting lever 8 has a presser foot lifting cam 16 capable of engaging with the cam engagement portion 14 from below. Referring to FIG. 2, when the presser foot lifting lever 8 is in a presser foot lowered position taking a downward-right incline position, the presser foot lifting cam 16 is disengaged with the cam engagement portion 14. Under such state, the presser foot 6 is pressed against a needle plate 1*a* of the bed 1 via the presser bar 7 by the compression coil spring 13. The workpiece can thus be pressed against the needle plate 1*a* by the presser foot 6.

When the presser foot lifting lever 8 is rotated counterclockwise in front view from the presser foot lowered position, the presser foot lifting cam 16 is brought in engagement with the cam engagement portion 14 and the presser foot 6 is lifted with the presser bar 7. As shown in FIG. 3, when the presser foot lifting lever 8 is in a presser foot lifted position taking a substantially horizontal disposition, the presser foot 6 is retained in the uppermost position and the workpiece can be moved between the presser foot 6 and the needle plate 1*a*. A thread loosening cam 17 is secured at the base end of the presser foot lifting lever 8.

Next, the presser foot lifting lever 8 will be described in detail.

Referring to FIGS. 2 to 7, the presser foot lifting lever 8 includes a lever body 20, a handle 21, and a connecting portion 22. The lever body 20 is rotatably supported by the head 4 about a longitudinally-oriented horizontal shaft center (shaft center of shaft member 15) intersecting the lengthwise-direction (lateral direction) of the arm 3. The handle 21 allows manual operation by the user. The connecting portion 22 foldably connects the handle 21 to the lever body 20.

The presser foot lifting lever 8 is arranged to allow the handle 21 to be switchable relative to the lever body 20 between the predetermined active position (refer to FIGS. 2 and 3) subject to operation and the predetermined retracted position (refer to FIG. 4) rearwardly rotated about 90 degrees from the active position.

Figure 5:
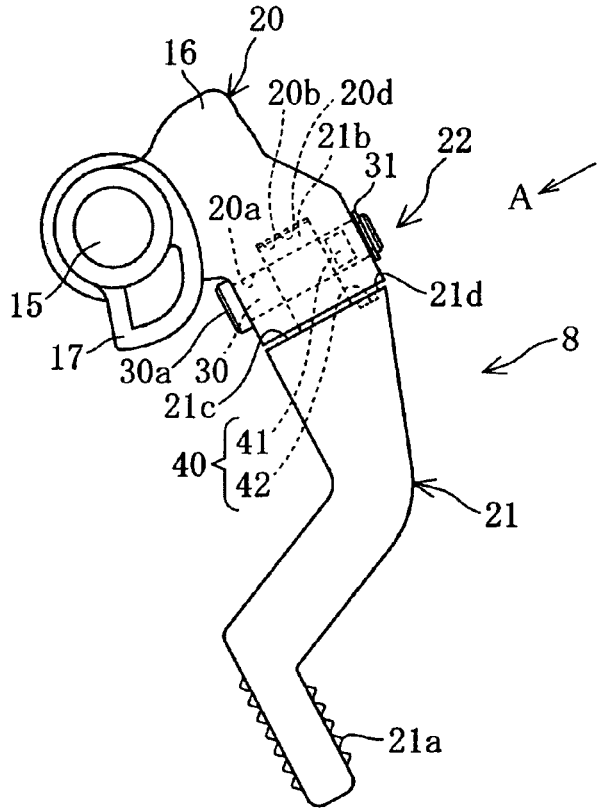
FIG. 5 is a front view of the presser foot lifting lever.
Figure 6:
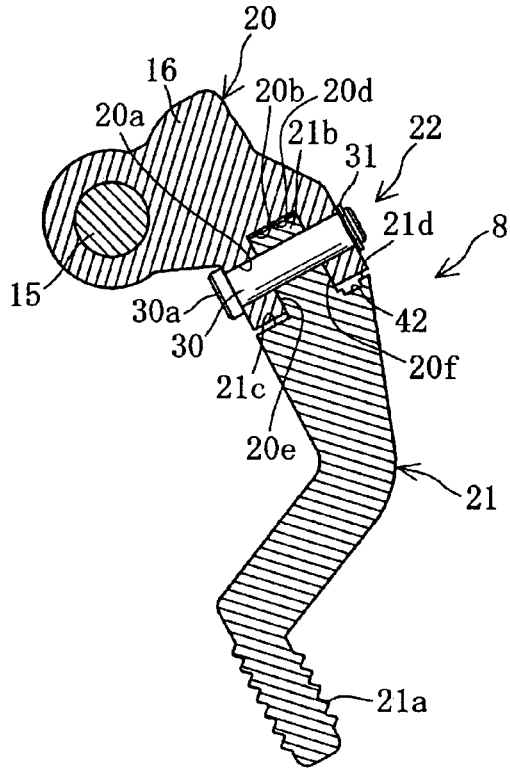
FIG. 6 is a vertical cross-section of the presser foot lifting lever.
Figure 7:
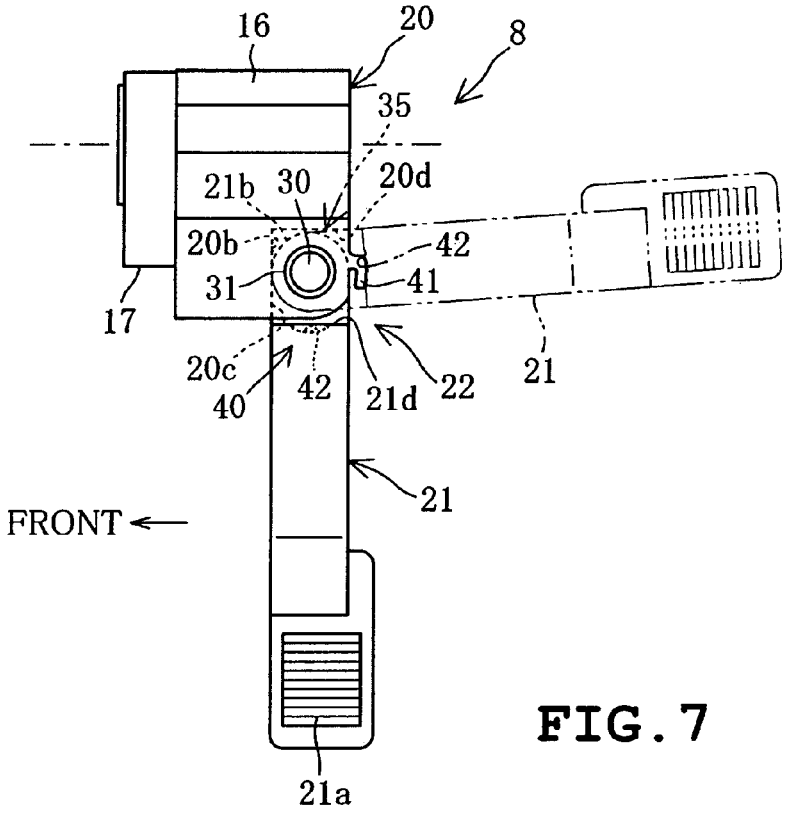
FIG. 7 is an arrow A view of FIG. 5.

Referring to FIGS. 5 to 7, the base end of the lever body 20 is rotatably supported by the machine frame of the head 4 via the shaft member 15. The lever body 20 has integrally formed thereto a presser foot lifting cam 16 and a thread-loosening cam 17. The handle 21 is in a substantially crank form. The base end of the handle 21 is connected to the distal end of the lever body 20 via the connecting portion 22. A handle body 21*a* having a plurality of projecting threads is formed on the distal end of the handle 21.

Referring to FIGS. 5 to 7, the connecting portion 22 includes a pin 30, a rotary regulator 35, and a handle position retainer 40. The pin 30 rotatably supports the handle body 21*a* to the lever body 20 about a shaft center intersecting the direction parallel to the horizontal shaft center. The rotary regulator 35 allows rotation of the handle 21 between the active position and the retracted position only. The handle position retainer 40 retains the handle 21 in the retracted position.

The pin 30 is fitted into a pin through-hole 20*a* penetrating the rear-side portion of the lever body 20 distal end and is secured unremovably to the lever body 20 by a head 30*a* of the pin 30 and a ring 31 attached to the distal end of the pin 30. In the rear-side portion of the lever body 20 distal end, a rectangular notched-hole 20*b* opened at the rear-side distal end is defined that communicates with the pin-through hole 20*b*.

The handle 21 has a connecting piece 21*b* that projects toward the base-end of the presser foot lifting lever 8. A pair of juts 21*c* and 21*d* projecting in a lateral direction of a plane parallel to the lengthwise direction of the pin 30 is formed in the base-end of the handle 21. Most of the connecting piece 21*b* is inserted into the notched-hole 20*b* and is rotatably fitted with the shaft directional mid-portion of the pin 30.

The lever body 20 has four walls, in other words, right angles, namely a pair of walls 20*c* and 20*d* (refer to FIG. 7) and a confronting pair of walls 20*e* and 20*f*. The base end face of the connecting piece 21*b* is formed in a circumferential profile and is in close proximity with the walls 20*c* and 20*d*. The connecting piece 21*b* is arranged to slide against the walls 20*e* and 20*f*. Also, the handle 21 is provided rotatably in a position in which the pair of juts 21*c* and 21*d* does not interfere with the lever body 20.

As shown by solid line in FIG. 7, when the connecting piece 21*b* abuts the wall 20*c*, the handle 21 is extended in the vertical direction to take the active position from which the handle 21 can no further be rotated clockwise as viewed in FIG. 7. Also, as shown by chain line in FIG. 7, when the connecting piece 21*b* abuts the wall 20*d*, the handle 21 is rearwardly extended to take the retracted position from which the handle 21 can no further be rotated counterclockwise.

Thus, the presser foot lifting lever 8 is mounted so as not to project into the recess F when the handle 21 is in the retracted position. Also, the presser foot lifting lever 8 is provided with a rotary regulator 35 that allows rotation of the handle 21 between the active position and the retracted position only by the walls 20*c* and 20*d*, or the like, by the lever body 20.

Referring to FIGS. 5 to 7, the handle position retainer 40 includes an elastic projection 41 formed on the lever body 20, an engagement portion 42 formed on the handle 21 with which the projection 41 is disengagably engaged when the handle 21 is in the retracted position.

The engagement portion 42 is composed of a recessed portion caved in a circumferential profile and formed on the jut 21*d* of the handle 21. The projection 41 is formed in a hook shape projecting reward from the rear face of the lever body 20 so as to be engagable with the engagement portion 42. Elastic deformation of the projection 41 allows smooth engagement and disengagement of the engagement portion 42. Thus, the handle 21 in the retracted position is reliably retained so as not to be readily moved toward the active position by vibration, or the like.

The operation and effect of the above described presser foot lifting lever 8 will be described hereinafter.

In case the presser foot 6 is to be vertically moved by using the presser foot lifting lever 8, the user is to switch the handle 21 to the active position and grasp the handle 21 to vertically swing the presser foot lifting lever 8, thereby vertically moving the presser foot 6 with the presser bar 7. As shown in FIG. 2, in case the presser foot lifting lever 8 is not in use (not operated) and sustained in the presser foot lowered position during the sewing operation, as shown in FIG. 4, the handle 21 can be rotated approximately 90 degrees reward from the active position and switched to the retracted position.

Hence, in case the user wishes to vertically move the presser foot 6, the presser foot lifting lever 8 can be reliably swung vertically by grasping the handle 21, with the handle 21 switched to the active position, thus enhancing the operability of the presser foot lifting lever 8. However, in case the presser foot lifting lever 8 is placed in the presser foot lowered position to lower the presser foot 6 during the sewing operation, the presser foot lifting lever 8 is in a downward incline and projects into the recess F, thereby causing the handle 21 of the presser foot lifting lever 8 to interfere with the user's hand or the workpiece.

Thus, in case the presser foot lifting lever 8 is not in use (not operated), the handle 21 is switched from the active position to the retracted position to prevent the handle 21 from interfering with the user's hands or the workpiece for better usability. Such arrangement also prevents presser foot interference when carrying or storing the sewing machine, which again, improves the usability.

The lever body 20 is supported rotatably about a horizontal shaft center intersecting the lengthwise direction (lateral direction) of the arm 3, and the handle 21 is attached so as not to project into the recess F when in the retracted position. Thus, the handle 21 can be reliably prevented from interfering with the user's hands and the workpiece even when rearranging the workpiece or sewing a sizable workpiece that projects into the recess F since the handle 21 does not project into the recess F.

Also, when the workpiece is rotated in the desired direction after lifting the presser foot lifting lever 8 to the presser foot lifted position with the sewing needle 5*a* penetrating the workpiece, the handle 21 can be prevented from projecting into the recess F by switching the handle 21 from the active position to the retracted position.

For example, the sewing machine M can be provided with a presser foot automatically moving mechanism that automatically moves the presser foot 6 in the vertical direction by way of electrical actuation with an operation of one of the operation switches without having to operate the presser foot lifting lever. In vertically moving the presser foot 6 by using the presser foot automatically moving mechanism, the handle 21 can remain switched from the active position to the retracted position to prevent interference of the presser foot lifting lever 8. In case the user wishes to make adjustments to the workpiece cloth, the presser foot 6 can be lifted by operating the presser foot lifting lever 8 after switching to a manually operatable position.

The connecting portion 22 includes a pin 30 rotatably supporting the handle 21 to the lever body 20 about a shaft center intersecting the direction parallel to the horizontal shaft center (horizontal shaft center oriented longitudinally so as to be perpendicular to the lengthwise direction of the arm 3); a rotary regulator 35 allowing rotation of the handle 21 between the active position and the retracted position only; and a handle position retainer 40 retaining the handle 21 in the retracted position. Thus, the handle 21 can be readily and reliably switched between the active position and the retracted position by way of rotation. Moreover, the handle 21 can be reliably retained in the retracted position to prevent the handle 21 from readily moving toward the active position by vibration, or the like.

The handle position retainer 40 includes an elastic projection 41 formed on the lever body 20, an engagement portion 42 formed on the handle 21 to which the projection 41 is disengagably engaged when the handle 21 is in the retracted position. Thus, the handle 21 can be reliably retained in the retracted position while enabling switching between the active position and the retracted position.

The presser foot lifting lever 8 of the first embodiment may be modified as follows.

Figure 8:
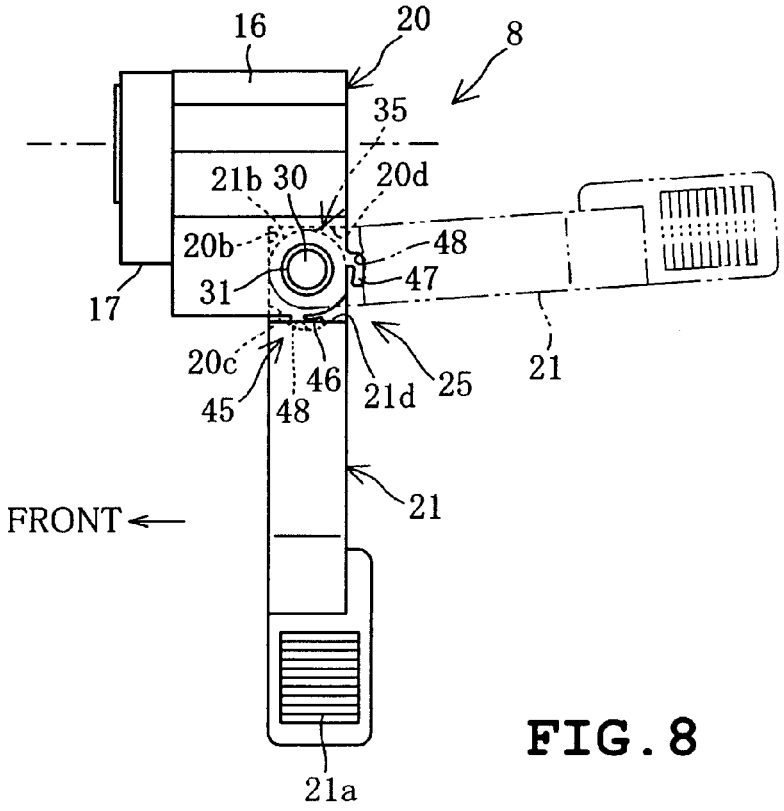
FIG. 8 corresponds to FIG. 7 and shows a modification of the first illustrative aspect of the present disclosure.
Figure 9:
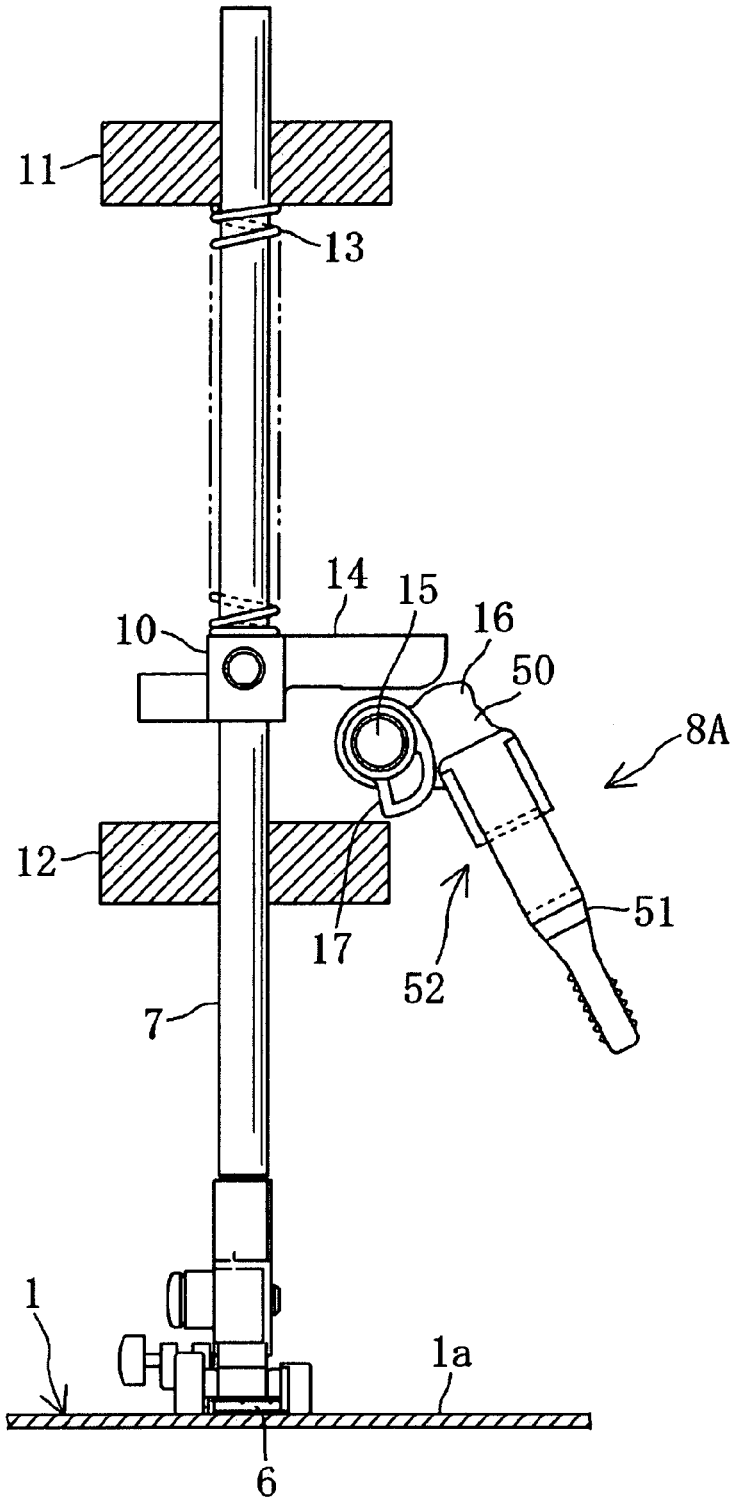
FIG. 9 is a front view of the presser foot lifting lever in the presser foot lowered position and the presser bar in accordance with a second illustrative aspect of the present disclosure.

1) As for the connection member 22, the handle 21 may be foldably connected to the lever body 20 by a hinge member instead of the pin 30.
2) As shown in FIG. 8, a connecting portion 25 that foldably connects the handle 21 to the lever body 20 may be provided with a handle position retainer 45 that retains the handle 21 in the active position and the retracted position respectively.

The handle position retainer 45 includes a pair of elastic projections 46 and 47 formed on the lever body 20, and an engagement portion 48 formed on the handle 21. The engagement portion 48 is disengagably engaged with the projection 46 when the handle 21 is in the active position and disengagably engaged with the projection 47 when the handle 21 is in the retracted position. The projection 46 and the engagement portion 48 have the same structure as the projection 41 and the engagement portion 42, where the projection 46 is formed in a hook shape downwardly projecting from the lower surface of the lever body 20 so as to be engagable with the engagement portion 48.

According to the above configuration, the elastic deformation of the projection 46 allows smooth execution of engagement and disengagement thereof with the engagement portion 48. Also, when the handle 21 is in the active position, the projection 46 in compressed state engages with the engagement portion 48 is reliably retains the active state to prevent the handle 21 in the active position to readily move toward the retracted position by vibration, or the like.

3) As for the handle position retainer 40 and 45, engagement portions 42 and 48 may possess elasticity instead of projections 41, 46, and 47.
4) The handle position retainer 40 and 45 may be arranged so that, the engagement portions 42 and 48 are formed on the lever body 20 and the projections 41, 46 and 47 are formed on the handle 21.
5) The connection portion 22 may be arranged so that the handle 21 is allowed to be retained in the active position and the retracted position respectively by friction exerted between the handle 21 and the pin 30 and/or friction exerted between the handle 21 and the walls 20*e* and 20*f* of the lever body instead of providing the handle position retainer 40 and 45 having the projections 41, 46, 47 and the engagement portions 42 and 48.

The second embodiment is a partial modification of the presser foot lifting lever 8 of the first embodiment. The structures that remain the same as the first embodiment are identified with the same references symbols and no detailed explanation will be given for the same. The second embodiment will be described hereinafter with reference to FIGS. 9 to 15.

The presser foot lifting lever 8A includes a lever body 50, a handle 51, and a connecting portion 52. The lever body 50 is rotatably supported by the head 4 about a longitudinally-oriented horizontal shaft center intersecting the lengthwise-direction (lateral direction) of the arm 3. The handle 51 allows manual operation by the user. The connecting portion 52 extendibly connects the handle 51 to the lever body 50.

The presser foot lifting lever 8A will be further described in detail. The presser foot lifting lever 8A is arranged to allow the handle 51 to be switchable relative to the lever body 50 between the predetermined active position (refer to FIGS. 10 and 11) subject to operation and the predetermined retracted position compressed from the active position (refer to FIGS. 12 and 13).

The base end of the lever body 50 is rotatably supported by the head 4 about the shaft member 15. The lever body 50 has integrally formed thereto a presser foot lifting cam 16 and a thread-loosening cam 17.

The handle 51 is formed in a linear shape and the base-end half thereof is connected to the distal end of the lever body 50 via the connecting portion 52. A handle body 51*a* having a plurality of projecting threads is formed on the distal end of the handle 51.

The connecting portion 52 includes a slide guide 60 slidably guiding the handle 51 to the lever body 50 and a slide regulator 70 that allows sliding of the handle 51 between the active position and the retracted position only.

The slide guide 60 is integrally formed on the distal end of the lever body 50. The slide guide 60 includes an engagement face 61 constituting a vertical front face; a pair of parallel engagement pieces 62 forwardly projecting from the engagement face 61; an engagement face 61 constituting a vertical rear face; and a pair of parallel engagement pieces 62 rearwardly projecting from the engagement face 61.

The front-side engagement face 61 and the pair of engagement pieces 62; and the rear-side engagement face 61 and the pair of engagement pieces 62 exhibit a longitudinally symmetrical arrangement. Each front and rear pair of engagement piece 62, which is spaced from one another by predetermined spacing, extends in the direction of extension of the handle 51, and a distal end 63 of the lever body 50 is positioned at the distal position intervening the front and rear engagement pieces 62.

Figure 11:
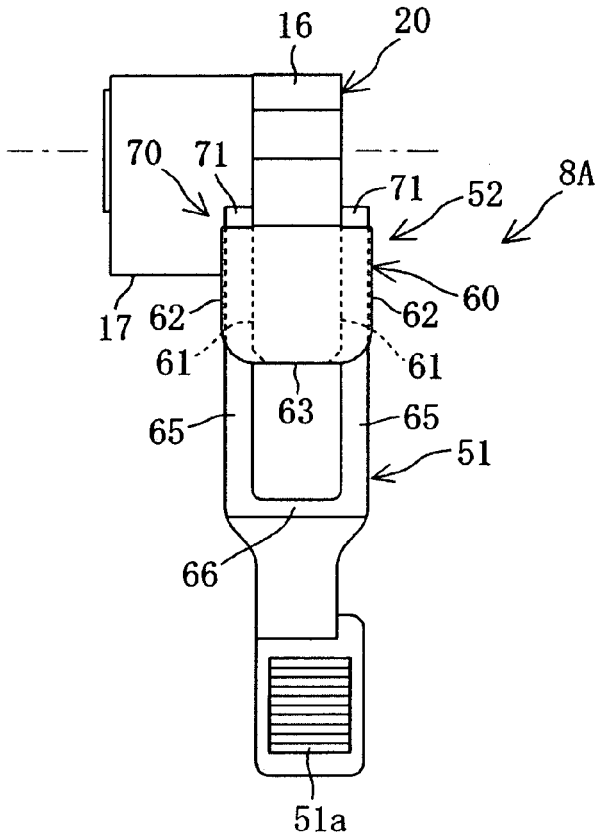
FIG. 11 is an arrow B view of FIG. 10.
Figure 12:
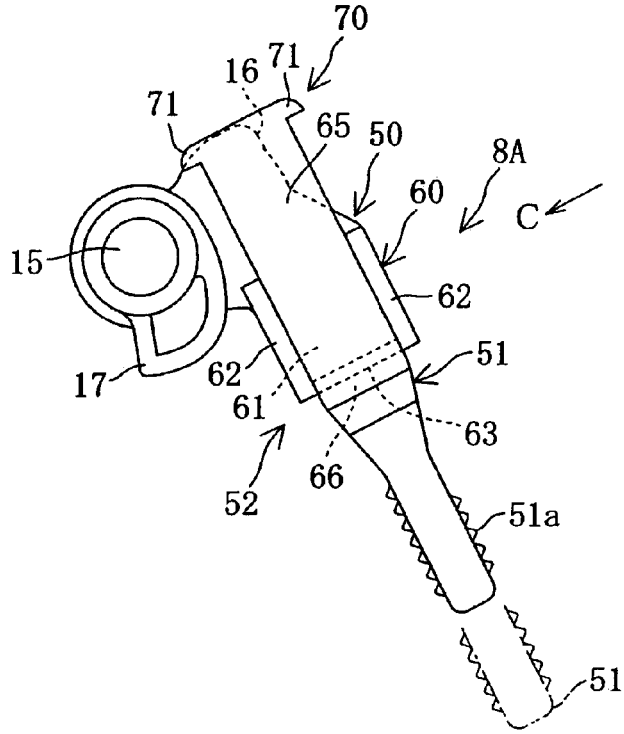
FIG. 12 is a front view of the presser foot lifting lever when the handle is in the retracted position.
Figure 13:
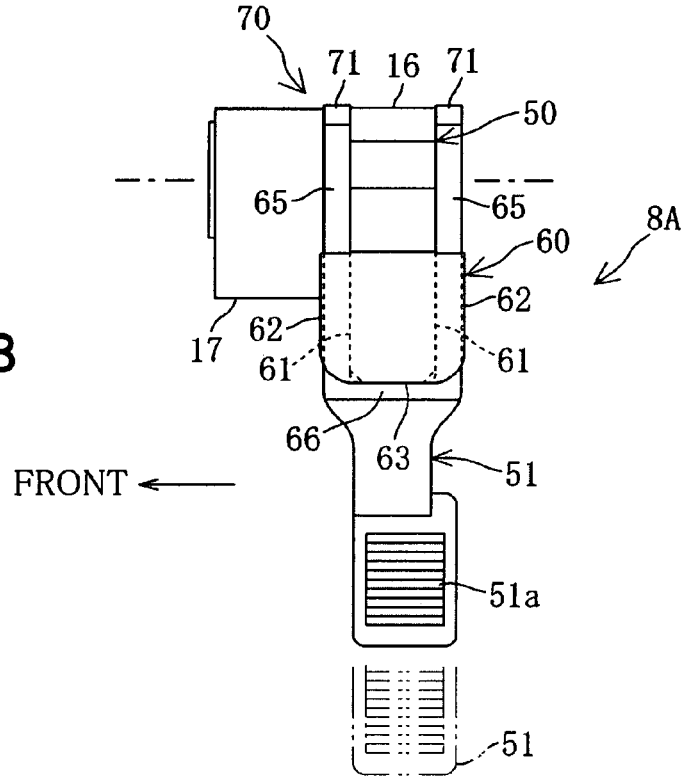
FIG. 13 is an arrow C view of FIG. 12.
Figure 14:
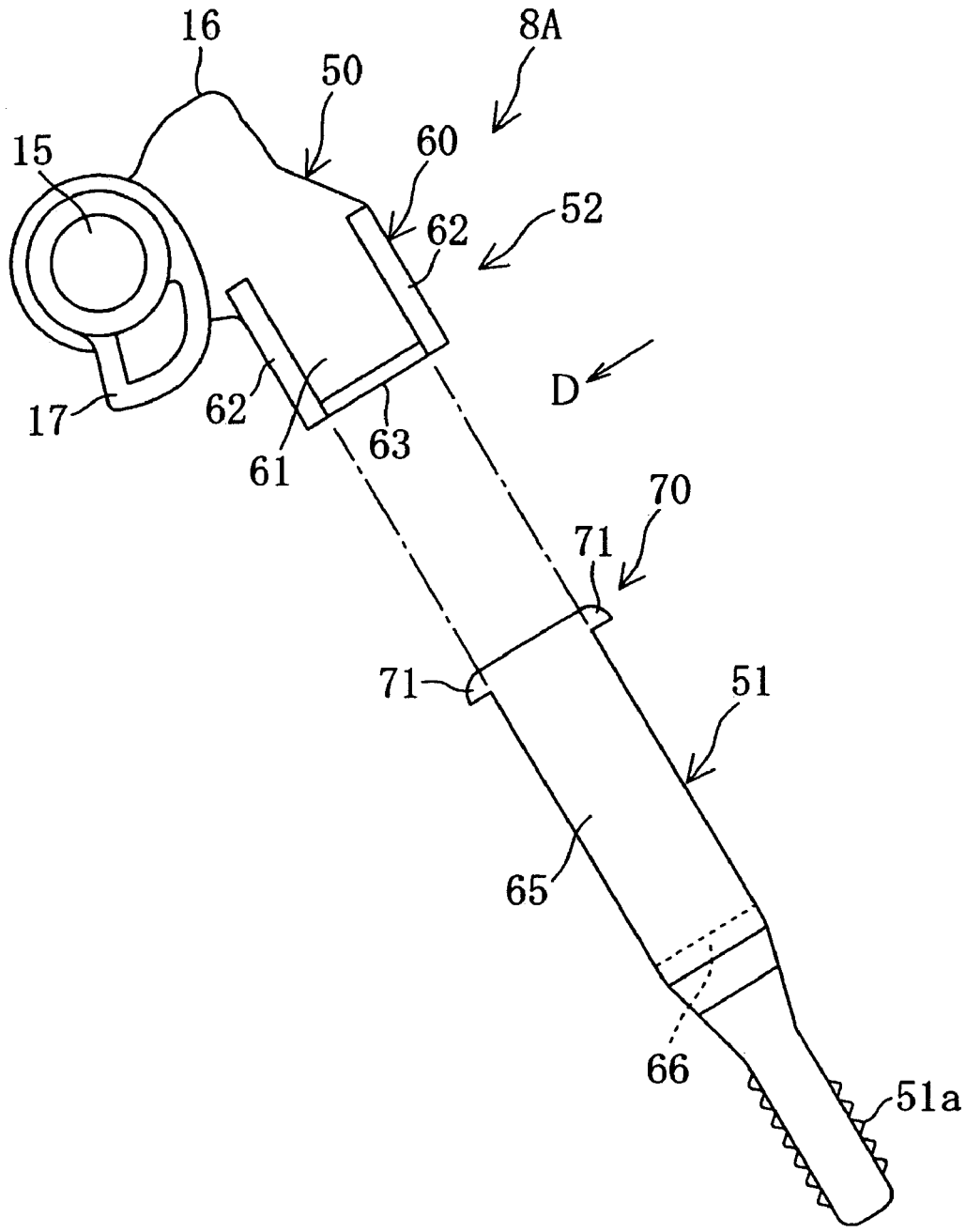
FIG. 14 is a broken front view of the presser foot lifting lever.
Figure 15:
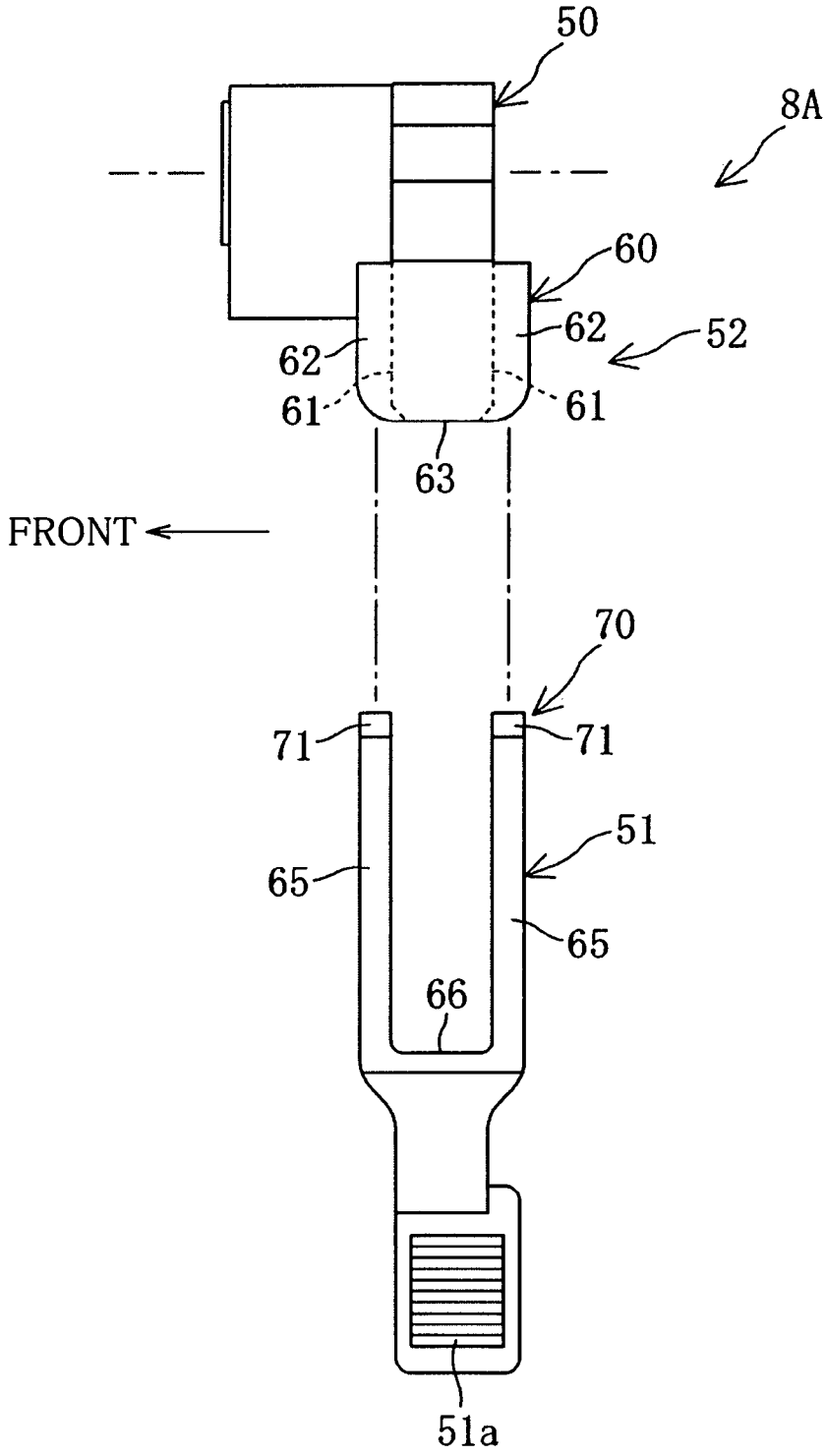
FIG. 15 is an arrow D view of FIG. 14.

On the other hand, the base-end half of the handle 51 is formed in a bifurcated profile having a pair of front and rear confronting side plates 65 and a bottom wall 66 connecting the side plates 65 (refer to FIGS. 11, 13 and 15). The front side plate 65 is in a slidable face to face contact with the front-side engagement face 61 while slidably engaging with the pair of engagement pieces 62 from the width direction. A pair of lock portions 71 projecting outward in the width direction of the side plates 65 is formed on the base end of respective side plate of the pair of side plates (refer to FIG. 14).

Figure 10:
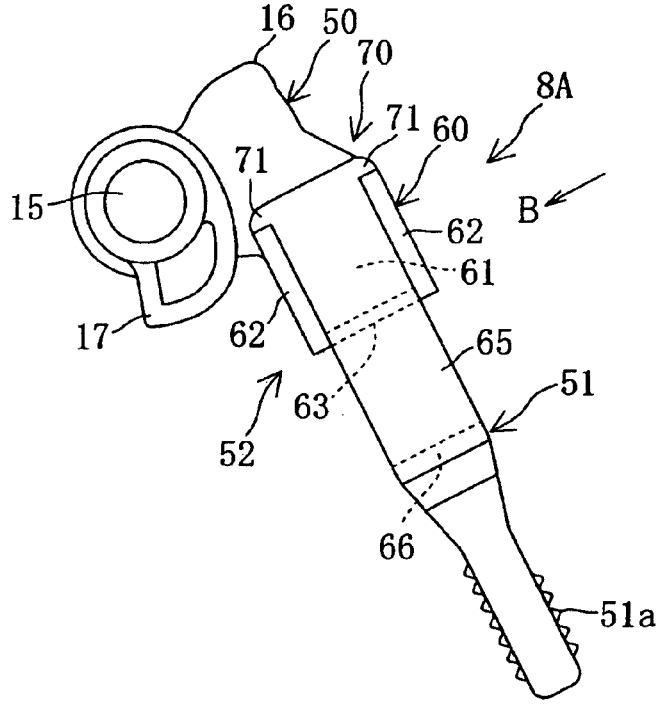
FIG. 10 is a front view of the presser foot lifting lever when the handle is in an active position.

Referring to FIGS. 10 and 11, when each front and rear pair of lock portions 71 is locked in abutment with the base end of the engagement piece 62, the handle 51 takes the active position and can no further slide toward the distal end as viewed in FIG. 10. Referring to FIGS. 13 and 14, when the bottom wall 66 of the handle 51 is locked in abutment with the distal end 63 of the lever body 50, the handle 51 takes the retracted position and can no further slide toward the base end.

Thus, a slide regulator 70 that allows sliding of the handle 51 between the active position and retracted position only is constituted by the distal end 63 and the engagement piece 62 of the lever body 50; and the bottom wall 66 and the lock portion 71 of the handle 51; or the like (also refer to FIG. 14 showing a broken perspective view and FIG. 15 showing the arrow D view of FIG. 14). Also, suitable friction is exerted between the engagement face 61 and engagement piece 62 of the lever body 50 and the side walls 65 of the handle 51, which friction allows the retention of the handle 51 in the active position and the retracted position respectively.

The connecting portion 52 of the presser foot lifting lever 8A includes a slide guide 60 slidably guiding the handle 51 to the lever body 50 and a slide regulator 70 that allows sliding of the handle 51 between the active position and the retracted position only. Thus, the handle 51 can be slid readily and reliably to render switching between the active position and the retracted position. Other primary operation and effects are the same as the first embodiment.

The presser foot lifting lever 8A of the second embodiment may be modified as follows.

1) The connecting portion may be arranged to slidably extend the handle 51 relative to the lever body 50 by fitting the handle 51 to the lever body 50 from the inner side or the outer side.
2) As in the first embodiment, the presser foot lifting lever 8A may be provided with a projection formed on either of the lever body 50 or the handle 51 and an engagement portion provided in the other of the lever body 50 or the handle 51 and disengagably engaging with the projection at least when the handle 51 is in the retracted position. Also, the presser foot lifting lever 8A may be provided with handle position retainer that retains the handle 51 at least in the retracted position by the engagement of the projection and the engagement portion.

The present invention is not limited to the foregoing descriptions but may implemented by incorporating various modifications within the scope of the principles of the invention and may be applied to various type of sewing machines.

For example, the presser foot lifting lever in accordance with the present invention may be applied to a sewing machine having a presser foot lifting lever rotatably mounted on the head about a laterally-oriented horizontal shaft center so as to project reward relative to the head. In such case, interference of the presser foot lifting lever can be prevented upon carrying or storing the sewing machine by switching the handle to the retracted position.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

What is claimed is:

1. A presser foot lifting lever for a sewing machine used for vertical operation of a presser foot that is mounted at a lower end of a presser bar supported by a head provided in a distal end of a sewing machine arm, the presser foot lifting lever comprising:

a lever body rotatably supported by the head about a horizontal shaft center;

a handle operated by a user;

a connecting portion connecting the handle to the lever body;

wherein the connecting portion connects the handle foldably relative to the lever body and a rotation of the handle allows the handle to be switched relative to the lever body between a predetermined active position taken to allow user operation and a predetermined retracted position taken when not in use.

2. The presser foot lifting lever of claim 1, wherein the lever body is supported rotatably about a horizontal shaft center intersecting a lengthwise direction of the arm, and the handle when in the retracted position is arranged so as not to project into a recess surrounded by a bed, a foot and the arm of the sewing machine.

3. The presser foot lifting lever of claim 1, wherein the connecting portion includes a pin supporting the handle to the lever body rotatably about a shaft center intersecting a direction parallel to the horizontal shaft center, a rotary regulator allowing rotation of the handle between the active position and the retracted position only, and a handle position retainer that retains the handle at least in the retracted position.

4. The presser foot lifting lever of claim 3, wherein the handle position retainer includes a projection formed at either one of the lever body or the handle and an engagement portion formed at the other of the lever body or the handle and engaged disengagably with the projection when the handle is in the retracted position.

5. The presser foot lifting lever of claim 1, wherein the connecting portion hingedly connects the handle to the lever body.

6. A presser foot lifting lever for a sewing machine used for vertical operation of a presser foot that is mounted at a lower end of a presser bar supported by a head provided in a distal end of a sewing machine arm, the presser foot lifting lever comprising:

a lever body rotatably supported by the head about a horizontal shaft center;

a handle operated by a user;

a connecting portion connecting the handle to the lever body;

wherein the connecting portion connects the handle extendibly relative to the lever body which extension allows the handle to be switched relative to the lever body between a predetermined active position taken to allow user operation and a predetermined retracted position taken when not in use.

7. The presser foot lifting lever of claim 6, wherein the connecting portion includes a slide guide guiding the handle slidably relative to the lever body, and a slide regulator allowing sliding of the handle between the active position and the retracted position only.

8. A sewing machine comprising:

an arm provided with a head at a distal end thereof;

a presser bar supported by the head and having a presser foot mounted at a lower end thereof; and a presser foot lifting lever operated to vertically move the presser foot, wherein the presser foot lifting lever includes:

a lever body rotatably supported about a horizontal shaft center by the head;

a handle operated by a user; and a connecting portion connecting the handle to the lever body, and wherein the connecting portion connects the handle foldably relative to the lever body and a rotation of the handle allows the handle to be switched relative to the lever body between a predetermined active position taken to allow user operation and a predetermined retracted position taken when not in use.

9. A sewing machine comprising:

an arm provided with a head at a distal end thereof;

a presser bar supported by the head and having a presser foot mounted at a lower end thereof; and a presser foot lifting lever operated to vertically move the presser foot, wherein the presser foot lifting lever includes;

a lever body rotatably supported about a horizontal shaft center by the head;

a handle operated by a user; and a connecting portion connecting the handle to the lever body, and wherein the connecting portion connects the handle extendibly relative to the lever body which extension allows the handle to be switched relative to the lever body between a predetermined active position taken to allow user operation and a predetermined retracted position taken when not in use.

* * * * *